US006631591B1

(12) United States Patent
Durham

(10) Patent No.: US 6,631,591 B1
(45) Date of Patent: Oct. 14, 2003

(54) CARPORT THAT PROTECTS VEHICLES FROM ELEMENTS

(76) Inventor: Steven Durham, 5333 Waterbury Way, Crestwood, IL (US) 60445

( * ) Notice: Subject to any disclaimer, the term of this patent is extended or adjusted under 35 U.S.C. 154(b) by 0 days.

(21) Appl. No.: 09/902,390

(22) Filed: Jul. 10, 2001

(51) Int. Cl.[7] ..... E04B 9/32

(52) U.S. Cl. ..... 52/73; 52/74; 14/7; 135/90

(58) Field of Search ..... 52/73, 74, 75, 52/78; 135/20.1, 21, 90, 91, 94, 98, 88.06; 248/122.1, 317; 14/7

(56) References Cited

U.S. PATENT DOCUMENTS

| | | | | | |
|---|---|---|---|---|---|
| 882,870 | A | * | 3/1908 | Cary | 52/75 |
| 1,018,522 | A | | 2/1912 | Savage | |
| 2,293,329 | A | | 8/1942 | Coburn | |
| 2,362,360 | A | | 11/1944 | Davis | |
| 2,694,231 | A | | 11/1954 | Bermejo | |
| 2,821,204 | A | | 1/1958 | Hartshorn, Sr. | |
| 2,869,562 | A | | 1/1959 | Francis | |
| D186,655 | S | | 11/1959 | Vetere | |
| 2,926,678 | A | | 3/1960 | Francis | |
| D192,212 | S | | 2/1962 | Schlager et al. | |
| 3,032,045 | A | | 5/1962 | Francis | |
| 3,032,046 | A | | 5/1962 | Francis | |
| 3,195,274 | A | * | 7/1965 | Itch | 52/74 |
| D225,051 | S | * | 11/1972 | Smithhart | 52/73 |
| 3,792,505 | A | * | 2/1974 | Saltzstein | 15/231 |
| 4,068,673 | A | * | 1/1978 | Bernardi | 135/5 R |
| 4,284,095 | A | | 8/1981 | Norton | |
| 4,313,279 | A | * | 2/1982 | Greenbaum | 47/29 |
| 5,109,643 | A | | 5/1992 | Speers | |
| 5,261,435 | A | * | 11/1993 | Stanley et al. | 135/90 |
| 5,441,067 | A | | 8/1995 | James et al. | |
| D363,790 | S | | 10/1995 | Boyd | |
| 5,499,644 | A | * | 3/1996 | Geniele | 135/20.1 |
| 5,579,797 | A | | 12/1996 | Rogers | |
| 5,622,011 | A | * | 4/1997 | Jines | 52/66 |
| D382,650 | S | | 8/1997 | Bauer | |
| D403,081 | S | * | 12/1998 | Luzzardi et al. | D25/56 |
| D412,993 | S | | 8/1999 | Chipman et al. | |
| D413,394 | S | | 8/1999 | Chipman et al. | |
| 5,937,881 | A | * | 8/1999 | Villa | 135/20.1 |
| D415,573 | S | * | 10/1999 | Chipman et al. | D25/56 |
| D421,132 | S | | 2/2000 | Chipman et al. | |
| 6,405,742 | B1 | * | 6/2002 | Driscoll | 135/96 |

FOREIGN PATENT DOCUMENTS

| | | | | |
|---|---|---|---|---|
| CN | 297255 | * | 2/1986 | 52/74 |

* cited by examiner

*Primary Examiner*—Lanna Mai
*Assistant Examiner*—Phi Dieu Tran A
(74) *Attorney, Agent, or Firm*—Ryndak & Suri

(57) ABSTRACT

A carport is provided having a rigid, concave canopy composed of a rigid self-supporting material and which has a width and length larger than that of a standard size automobile. The carport further includes a supporting structure that is rigidly connected to and extends vertically from the canopy. The carport still further includes a horizontally extending longitudinally extending support member that is rigidly secured to the supporting structure and laterally spaced from the canopy.

16 Claims, 5 Drawing Sheets

CARPORT THAT PROTECTS VEHICLES FROM ELEMENTS

TECHNICAL FIELD

The present invention relates to a carport structure, and more particularly to a carport structure having a rigid, frame-less concave canopy that can be light transmissive.

BACKGROUND OF THE INVENTION

A need exists for a carport that protects vehicles from natural environmental concerns while still providing an unobstructed view of the vehicles.

A need also exists for a carport that reduces the amount of sun, UV rays, rain, hail, light snow and other elements that possibly could make contact with vehicles, yet also remains aesthetically pleasing, complements the surroundings, and allows the car to be on display.

In addition, a need exists for a carport suited for people that do not desire to keep their vehicles in a garage or other enclosed structure, but still want to keep them sheltered, particularly without significantly obstructing the natural view of the surrounding environment.

SUMMARY OF THE INVENTION

In accordance with the present invention, a carport is provided. The carport includes a rigid, concave canopy that is composed of a rigid self-supporting material. Consequently, the canopy can be a frame-less structure, that is, a frame to support the canopy is not required. The canopy typically has a width and length larger than the width and length of a standard size automobile. The carport further includes a suitable supporting structure that rigidly connects to the canopy, so that the canopy is mounted in a fixed position spaced above the ground a desired distance. Preferably, the carport structure in accordance with the invention includes a longitudinally extending support member rigidly secured to the canopy and to a laterally, generally horizontally extending supporting structure that has an end or a portion that is laterally spaced from the canopy. The end or portion of the laterally extending supporting structure that is laterally spaced from the canopy can be secured to another structure that provides the desired elevation for the rigid canopy. Typically, that structure will be a generally vertically extending post member mounted directly or indirectly to the ground, or to other suitable structure.

In accordance with one aspect of the invention, the rigid, concave canopy is composed of light transmissive material which maybe transparent or translucent. In another embodiment, it is composed of transparent material, which may include a one-way mirrored material, on either side and typically so that a person below the canopy can see upward through the canopy, but a person above the canopy cannot see downwardly through it. Thus, it is contemplated that in one embodiment the canopy will provide for a substantially unobstructed view of both the vehicle underneath it and the surrounding environment.

In accordance with another aspect of the invention, the rigid, concave canopy has a radius of curvature in the range of from about 5 to 30 feet or more. Such a radius of curvature will provide for an adequate shelter for the vehicle, while also providing enough of a curve for debris and rain runoff.

In accordance with another aspect of the invention, the rigid canopy is composed of a plurality of rigid, self-supporting concave panels attached or secured together in side-by-side complementary relationship. While the canopy material is rigid, it is to be understood that rigid materials inherently will flex to some degree. In one embodiment, each concave panel is suitably secured to another concave panel with, for example, a correspondingly concave or flexible channel member, or other suitable structure. In another embodiment, the transverse edge of each concave panel is secured within a channel member. In another embodiment, the edge of each concave panel is adhered within a channel member.

In accordance with another aspect of the invention, one or more peripheral edging strips are secured to the peripheral edge of the rigid canopy, which rigid canopy may be composed of a plurality of concave panels. In one embodiment, the edging is composed of rigid acrylic material that can be transparent. In another embodiment, the edging is composed of flexible material. The edging provides additional protection of the panels, especially the panel edge, from environmental hazards and shock.

In accordance with another aspect of the invention, the longitudinally extending support member is constructed in a desired configuration and may include two pairs of I-beams, connected together, on a single I-beam or a square beam or pair of square beams with one pair or one beam rigidly attached to the supporting structure and with one pair located on different longitudinal portions of the canopy, which may be different longitudinal half portions of the canopy.

In accordance with another aspect of the invention, the longitudinally extending support member may further include arcuate members laterally spaced along the canopy length that are formed to allow attachment to the canopy at two transversely spaced areas taking into account the canopy's radius of curvature, and have straight vertically extending ends. It is contemplated that the arcuate members are composed of a rigid structural material. In one embodiment, the arcuate members are composed of stainless steel tubing formed to provide the desired configuration such as in an arch shape. The arcuate members are composed of any suitable material including aluminum, steel and composite materials.

In accordance with another aspect of the invention, each arcuate member further includes reinforcing arms that are suitably attached, such as by welding, to inside the tubular arch and also have straight ends. It is contemplated that the reinforcing arms are composed of the same material as that of the arcuate member.

Alternatively, in place of the arcuate members may be utilized angular support members.

In accordance with another aspect of the invention, the longitudinally extending support member further includes flanges that attach the ends of the arcuate members to the rigid, concave canopy. The flanges provide for a secure attachment to the rigid canopy and allow a relatively uniform distribution of forces on the canopy. It is contemplated that the flanges attach to the canopy by any suitable structure, such as, for example, with threaded fasteners, which may be by bolts. It is alternatively contemplated that the flanges attach with a suitable adhesive. The surface of the flange that abuts the canopy may have a curvature to match the canopy in the area of abutment.

In another aspect of the invention, curved or angled flanges are located underneath the canopy in a location directly opposite and complementary to the flanges. This embodiment will allow the concave panels to be rigidly secured and held together.

Alternatively, bolts may be embedded in the canopy material, which can eliminate the need for a bottom flange.

Numerous advantages may be realized by the present invention. For example, the unobstructed view of the sheltered vehicle can provide for a display and draw attention to the sheltered vehicle. This factor will appeal to people who wish to draw attention to their vehicles, possibly because of their rarity or prestige. Alternatively, commercial dealers that display many vehicles, for example, car or boat dealers, will be able to fully put on view and display the vehicles, while simultaneously protecting such vehicles from environmental elements.

In addition to providing for a full view of the protected vehicle, the transparent canopy has the advantage of preserving the view of the surrounding environment in which the carport is placed. This aspect will especially appeal to people that live in aesthetically pleasing locales that include, for example, mountains, water, trees, flowers, or even other buildings. With this carport, people will be able to protect their vehicles with only a very minimal obstruction on the view of the corresponding surrounding area.

DETAILED DESCRIPTION OF THE INVENTION

Figure 1:
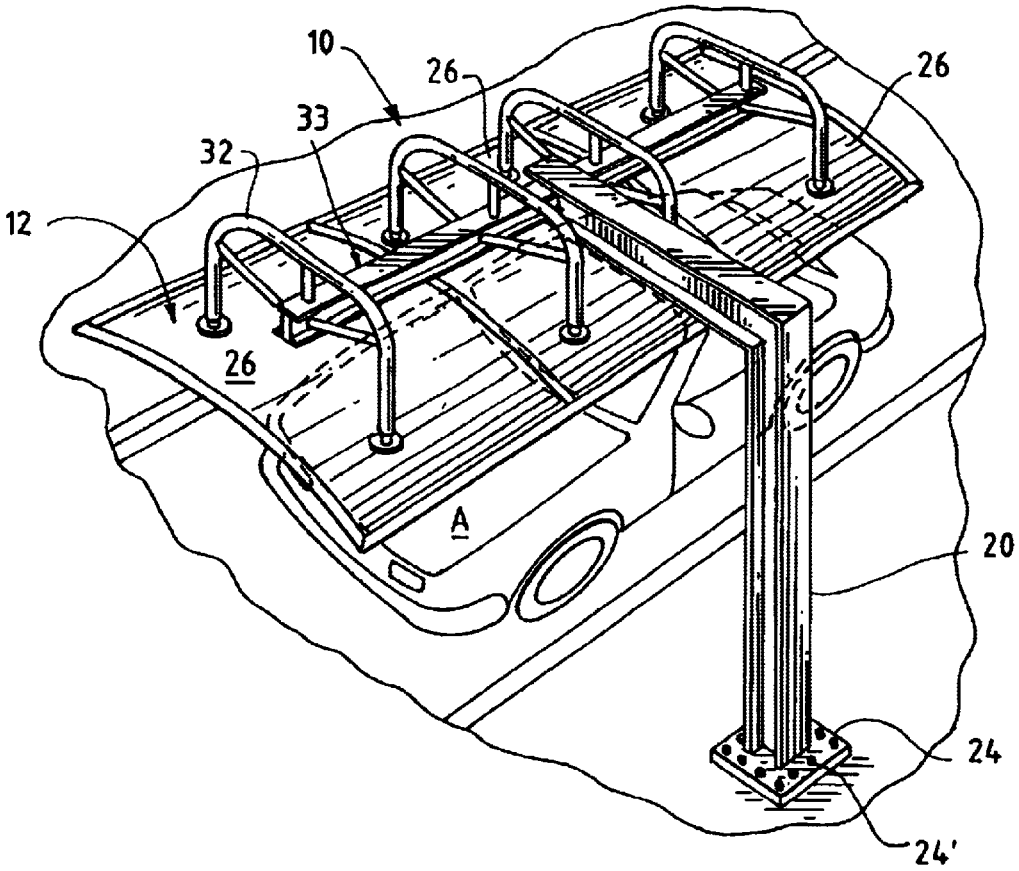
FIG. 1 illustrates a perspective view of a device in accordance with the present invention

Referring to the figures generally, there is illustrated a carport 10 in accordance with the invention. Carport 10 includes a rigid, self-supporting concave canopy 12 that is composed of a rigid self-supporting material, and that typically is of a width and length larger than the width and length of a standard size automobile A. Carport 10 also includes a supporting structure 14 that rigidly connects to and extends vertically from canopy 12. Carport 10 further includes a horizontally extending longitudinally extending support member 16 that rigidly secures to supporting structure 14 and has an end 18 that is laterally spaced from canopy 12. Member 16 may be an I-beam as illustrated or may be any desired structure such as a tubular or box-like structural member, as long as it is capable of providing the desired structural support.

Figure 3:
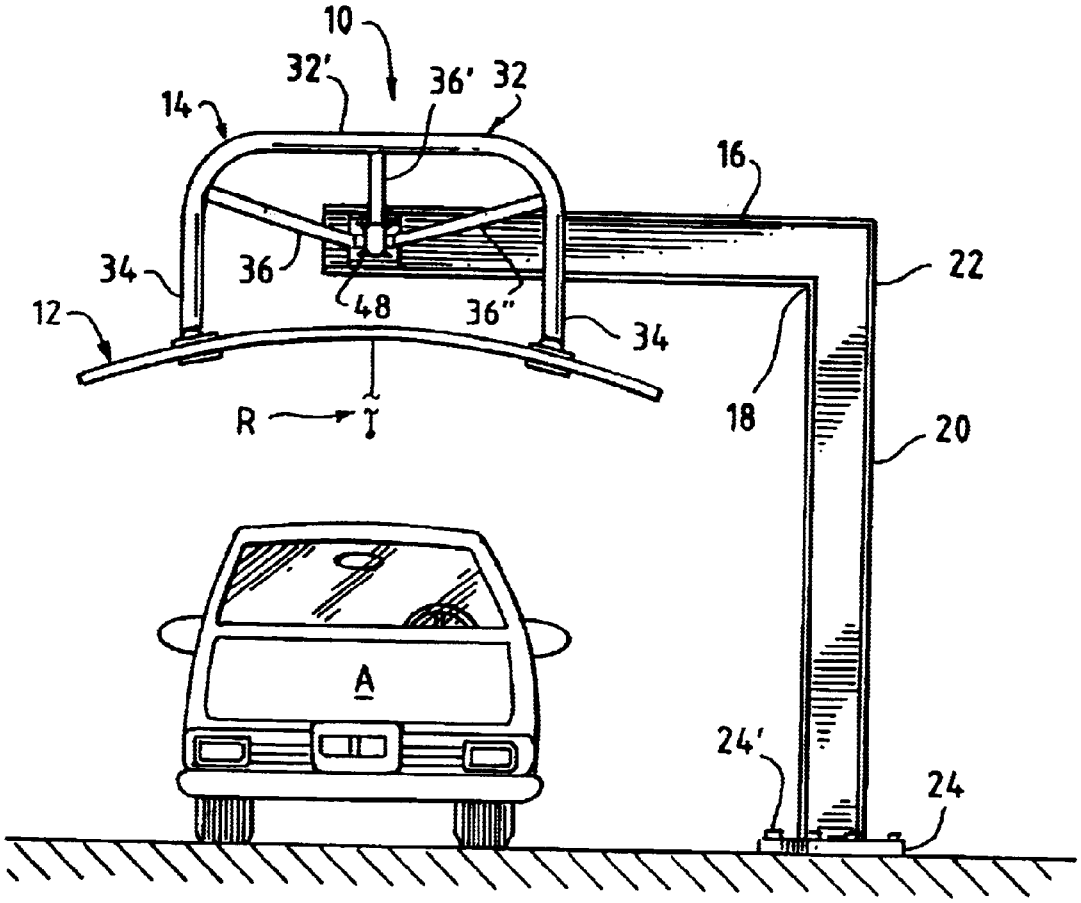
FIG. 3 illustrates a front elevation view of the device of FIG. 1 in an upright position.

Carport 10 further includes a generally vertical post member 20, which in this case is an I-beam, although any suitable structure can be used, that has an upper portion 22 to which laterally spaced end 18 of support member 16 is connected, as illustrated in FIGS. 1 and 3. I-beam vertical post member 20 extends laterally past the edge of canopy 12, as illustrated in FIGS. 1 and 3. Post member 20 is suitable for mounting to a supporting surface, such as a base plate 24, to which it is mounted with bolts 24', as illustrated in FIGS. 1 and 3. Alternatively, post member 20 can be mounted to a foundation (not shown) or other suitable structure. Alternatively, end 18 could be mounted to a building or other suitable structure to provide the desired elevation for canopy 12.

Rigid, concave canopy 12 can be composed of a desired material and may be either light transmissive material or transparent material. This will provide for an unobstructed view of both what is sheltered underneath the canopy and of the corresponding, surrounding environment, as shown in FIGS. 1 and 3, particularly when the canopy is transparent.

Rigid, concave canopy 12 has a radius of curvature R of from about five to thirty feet, as shown in FIG. 3. Such curvature will provide enough of a slope for debris and rain runoff.

Figure 2:
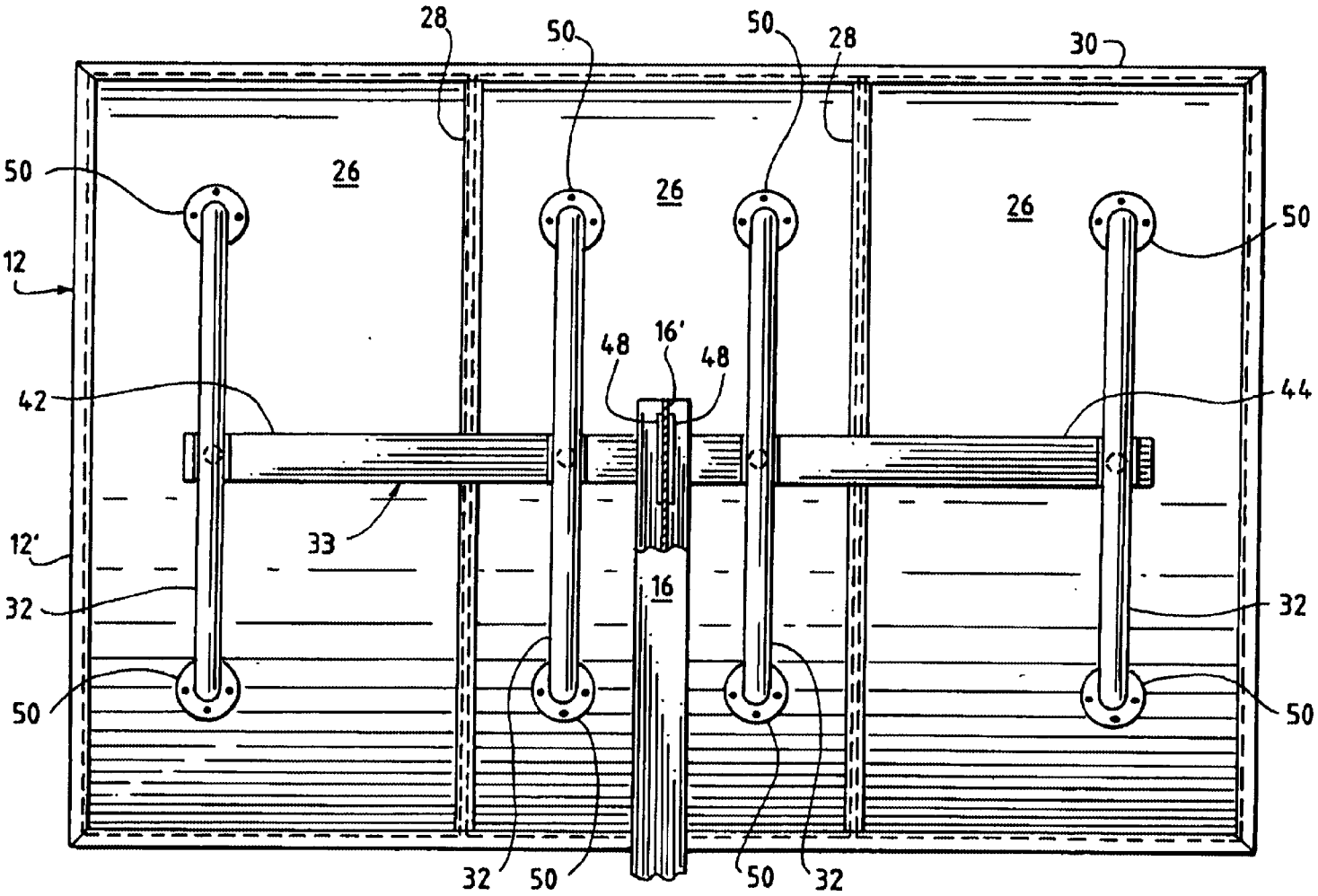
FIG. 2 illustrates a top plan view of the device of FIG. 1.
Figure 6:
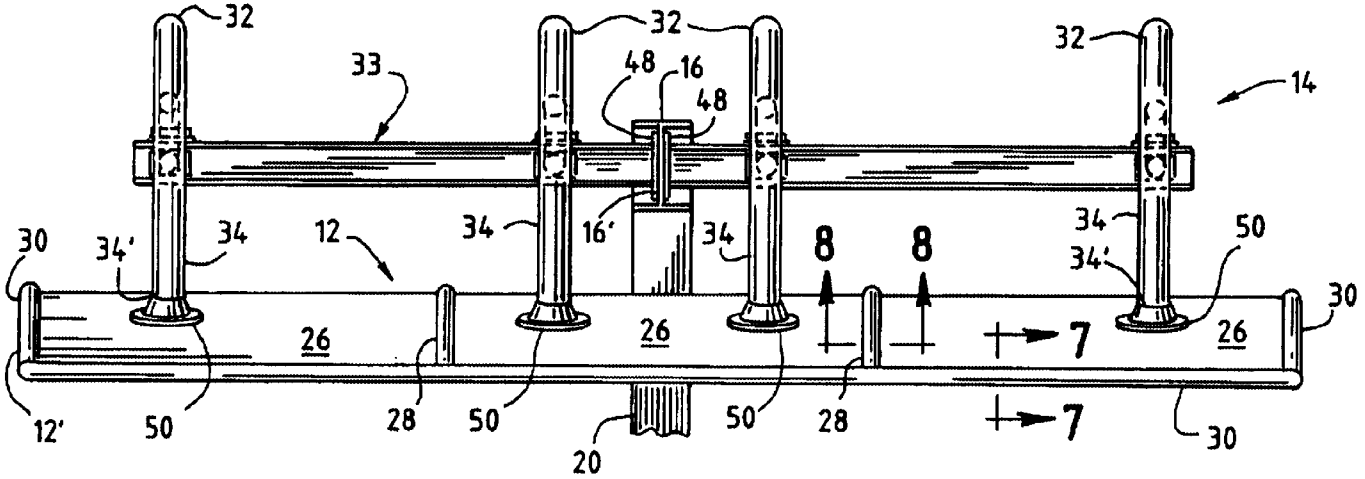
FIG. 6 illustrates a side elevation view of a portion of the device of FIG. 1.
Figure 8:
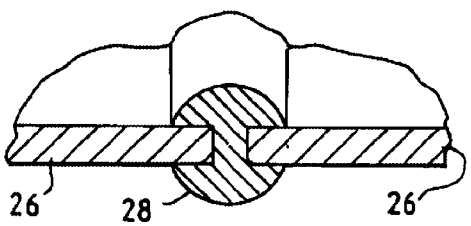
FIG. 8 illustrates a sectional view along line 8—8 of FIG. 6.
Figure 7:
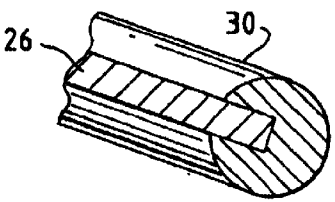
FIG. 7 illustrates a sectional view along line 7—7 of FIG. 6.

Rigid, concave canopy 12 of carport 10 may be composed of a single panel (not shown) or a plurality of rigid, self-supporting concave panels 26 secured in side-by-side relationship, as best shown in FIG. 2. Each concave panel 26 is secured to another concave panel 26 with a concave channel member 28, which is shown in FIGS. 6 and 8. Each concave panel 26 can be bonded into concave channel member 28, which can be accomplished by use of a suitable adhesive, for example, or by a friction fit. Outer concave panels 26 are secured into a concave panel edging strip 30, which is shown in FIGS. 6 and 7. Panel edging 30 protects the edges of panels 26 from the elements and ensures that they remain secured together.

Rigid, concave canopy 12 is suspended from supporting structure 14, as illustrated in FIGS. 1–3. Alternatively, supporting structure 14 could be located below the canopy instead of above (not shown).

Figure 4:
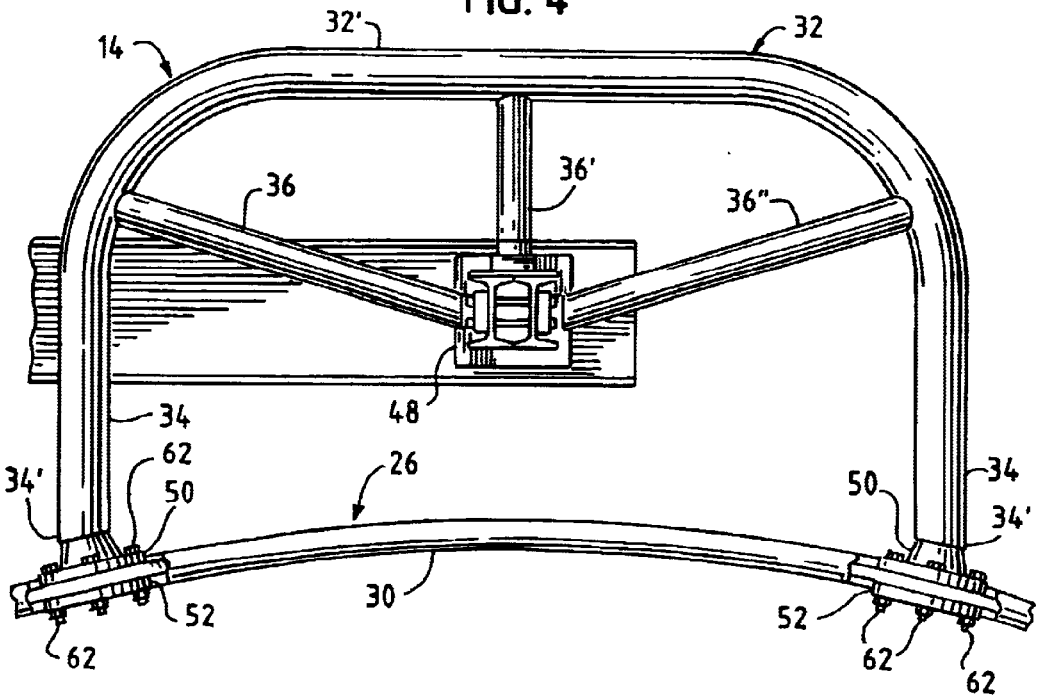
FIG. 4 illustrates an enlarged perspective front elevation view of a portion of the device of FIG. 1.

In the illustrated embodiment, supporting structure 14 is composed of a plurality of longitudinally spaced arcuate members 32 that conform to the canopy's radius of curvature and have vertically extending straight portions 34, as best shown in FIGS. 4 and 6. Arcuate members 32 are composed of a rigid material, such as tubular steel or aluminum, for example, and may be composed of stainless steel tubing that is bent or otherwise formed to provide the desired configuration. Each arcuate member 32 connects to canopy 12 at two transversely spaced apart locations, as illustrated in FIG. 4.

Arcuate members 32 are mounted to a longitudinally extending support member 33 that forms part of support structure 14 by means of reinforcing arms 36, 36' and 36", which together with arcuate members 32, form a rigid structure, as best illustrated in FIG. 4. Arcuate members 32 in one embodiment have a central horizontally extending portion 32', as shown in FIGS. 3 and 4, for example. Arcuate members 32 can be of a shape as desired. Reinforcing arms 36, 36' and 36" provide additional support for arcuate members 32 to ensure structural integrity. Reinforcing arms 36, 36' and 36" include ends 38, 38' and 38" and can be composed of the same material as that of arcuate member 32. Arms 36, 36' and 36" each have ends **36*a*, 36*a*'and 36*a*" and are rigidly secured to support member 16, such as by welding or otherwise securing a block 56, 56' and 56" to a respective plate 58 or for blocks 56 and 56" to vertical side 42' and 44' of I-beams 42 and 44, respectively, such as with nuts and bolts 60 and 62. Alternatively, any other suitable structure could be utilized to form the desired rigid connection of arms 36, 36' and 36" to longitudinal support member 33. The two downwardly depending spaced apart ends 34' of each arcuate member 32 are secured to correspondingly transversely spaced apart areas of canopy 12 as hereinafter described in greater detail with particular reference to FIG. 4**.

Longitudinally extending support member 33 is preferably located above the longitudinal centerline of canopy 12, as shown in FIGS. 1 and 4, for example, and may be in any suitable configuration. In an alternate embodiment (not shown), member 42 of longitudinally extending support member 33 or similar structure could extend longitudinally past one longitudinal end of canopy 12 (such as end 12' in FIGS. 2 and 6) for mounting to a vertical post or other member (not shown) or to a wall (not shown), for example, or other supporting structure.

Figure 5:
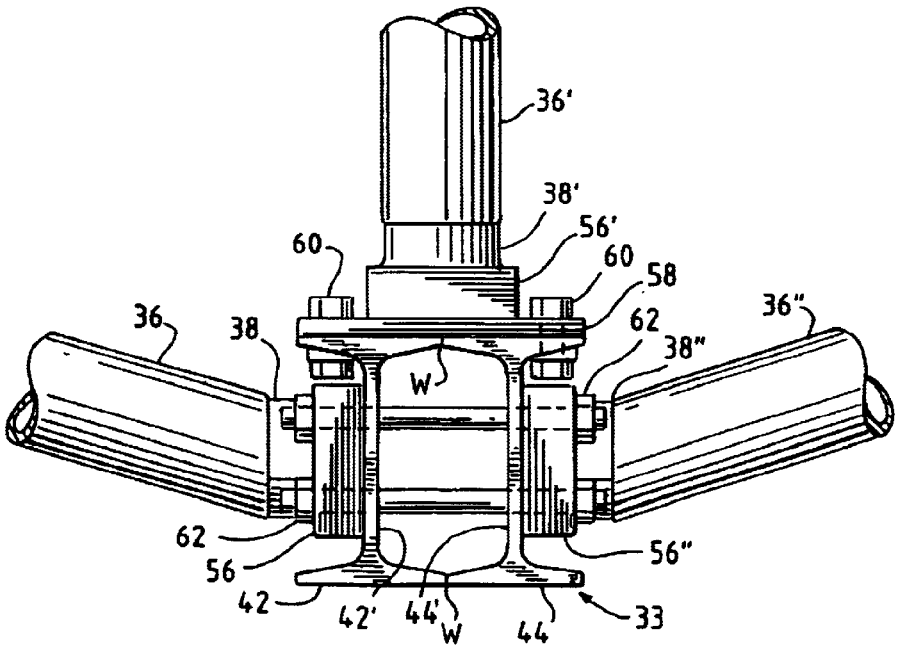
FIG. 5 illustrates a sectional front view of a portion of the longitudinally extending support member of the device of FIG. 1.

In the illustrated embodiment as shown in FIG. 5, longitudinally extending support member 33 is composed of two pairs of I-beams, 42 and 44 respectively, connected together by any suitable structure, such as by welds W, for example, one pair being located on each longitudinal half portion of canopy 12, as shown in FIG. 2. The longitudinally extending support member 33 is securely connected to a transversely extending support member 16, which is illustrated in FIGS. 1 and 2, for example, and as illustrated is an I-beam. End plates 48 are located at the ends of longitudinally extending support member 33 that are secured to the vertical portion 16' of I-beam or member 16 via bolts, as illustrated in FIGS. 4 and or other suitable structure.

Ends 34' of members 32 have flanges 50 that attach ends 34' of arcuate members 32 to rigid, concave canopy 12, as shown in FIGS. 3, 4 and 6. These flanges 50 preferably have a curved contacting surface for contact with the curved surface of panels 26 and thus preferably are curved to the corresponding curvature of the concave panel, as shown in FIG. 3. In addition, each flange 50 has a complementary flange 52 located on the opposite surface of canopy 12 in a location directly corresponding to flange 50 and that is curved to correspond to the curvature of the concave panel, as shown in FIGS. 3 and 4. Each pair of flanges 50 and 52 are secured together with one of panels 26 therebetween by suitable fasteners such as nuts and bolts 62 that extend through the respective panels 26, as shown in FIG. 4. Alternatively, a suitably curved blocking member could be located between the flanges and respective panel 26. To isolate panels 26 from vibration and/or shock from support structure 14, a thin, flexible bushing or pad (not shown) may be interposed between each of flanges 50 and 52 and respective panel 26, which may be constructed of suitable material as desired, such as rubber, vinyl material or polyurethane material, which may be transparent, for example.

Figure 9:
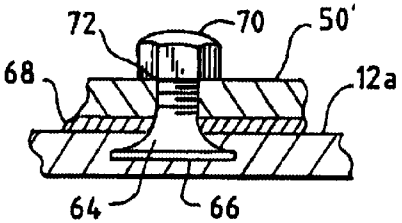
FIG. 9 illustrates a sectional view of an alternate embodiment of attaching structure useful in accordance with the invention.

An alternate attachment system is illustrated in FIG. 9. A bolt 64 has an end 66 that is embedded in canopy 12*a*, which is similar to canopy 12. End 66 is preferably of relatively large cross-sectional area to distribute forces over a relatively large area of canopy 12*a*.

Flange 50', similar to previously described flange 50 is shown in a fragmentary sectional elevation view. Interposed between flange 50' is a bushing 68 which may be constructed of relatively flexible material such as rubber, vinyl material or polyurethane material, which may be transparent. A nut 70 is threadably fastened onto threaded portion 72 of bolt 64 to secure flange 50' to canopy 12*a*. Any other suitable structure to fasten the supporting structure to the rigid canopy may be used in accordance with the invention.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

What is claimed is:

1. A shelter comprising:

a rigid canopy composed of a rigid self-supporting material, said canopy having a width and a length;

a supporting structure rigidly connected to and extending vertically from said canopy;

a longitudinally extending support member rigidly secured to said supporting structure and having a laterally extending structural member having an end that is laterally spaced from said canopy;

wherein the longitudinally extending support member further comprises two pairs of I-beams that are connected together, and with one pair located on each longitudinal half portion of the canopy.

2. The shelter of claim 1 further comprising:

a generally vertical post member having said laterally spaced end of said lateral structural member connected to an upper portion thereof, the post member being suitable for mounting to a supporting surface.

3. The shelter of claim 1 wherein the rigid canopy is composed of light transmissive material.

4. The shelter of claim 1 wherein said canopy is concave and said rigid, concave canopy is composed of transparent material.

5. The shelter of claim 1 wherein said canopy is concave and said rigid, concave canopy has a radius of curvature in the range of from about five to about thirty feet.

6. The shelter of claim 1 wherein said canopy is concave and said rigid canopy is composed of a plurality of rigid, self-supporting concave panels of a curvature that are secured in side-by-side relationship.

7. The shelter of claim 6 wherein said canopy is concave and each concave panel is secured to another concave panel with a concave channel member.

8. The shelter of claim 7 wherein said canopy is concave and the outer concave panels are secured into a concave panel edging strip.

9. The shelter of claim 1 wherein the rigid canopy is rigidly suspended from the supporting structure.

10. The shelter of claim 1 wherein the supporting structure is located below the rigid canopy.

11. A shelter comprising:

a rigid canopy composed of a rigid self-supporting material, said canopy having a width and a length;

a supporting structure rigidly connected to and extending vertically from said canopy;

a longitudinally extending support member rigidly secured to said supporting structure and having a laterally extending structural member having an end that is laterally spaced from said canopy;

wherein the supporting structure comprises a rigid, longitudinally extending structure including a centrally disposed member vertically spaced from and extending generally along the longitudinal center of the canopy and a plurality of longitudinally spaced arcuate members fastened to the canopy and secured to and spaced apart along the length of the central longitudinal member.

12. The shelter of claim 11 wherein the arcuate members are composed of a rigid material.

13. The shelter of claim 11 herein each arcuate member further comprises a plurality of straight reinforcing arms, rigidly secured to inside the arcuate member and mounted to the longitudinally extending support member.

14. The shelter of claim 11 wherein said canopy is concave and the member further comprises a flange attached to each end of the arcuate members for securing the arcuate members to the rigid, concave canopy.

15. The shelter of claim 14 wherein said canopy is concave and the flanges that attach the ends of the arcuate members to the rigid, concave canopy further comprise corresponding flanges located underneath the canopy opposite the flanges attached to the ends of the arcuate members.

16. A shelter comprising:

a rigid canopy;

a supporting structure rigidly connected to and extending vertically from said canopy;

a longitudinally extending support member rigidly secured to said supporting structure and having a laterally extending structural member having an end that is laterally spaced from said canopy; and wherein the longitudinally extending support member further comprises two pairs of I-beams that are connected together and with one pair located on each longitudinal half portion of the canopy.

* * * * *